US005944099A

United States Patent [19]

Sas-Jaworsky

[11] Patent Number: 5,944,099

[45] Date of Patent: Aug. 31, 1999

[54] INFUSER FOR COMPOSITE SPOOLABLE PIPE

[75] Inventor: Alexander Sas-Jaworsky, Houston, Tex.

[73] Assignee: Fiber Spar and Tube Corporation, West Wareham, Mass.

[21] Appl. No.: 08/823,821

[22] Filed: Mar. 25, 1997

[51] Int. Cl.[6] ..... E21B 19/22

[52] U.S. Cl. ..... 166/77.2; 166/84.2

[58] Field of Search ..... 166/77.2, 84.2, 166/84.1, 84.4, 384, 385, 379; 175/84

[56] References Cited

U.S. PATENT DOCUMENTS

| | | | |
|---|---|---|---|
| 2,674,474 | 4/1954 | Lister | 166/84.2 |
| 4,647,050 | 3/1987 | Johnson | 166/84.2 |
| 4,981,174 | 1/1991 | White | 166/84.2 |
| 4,986,360 | 1/1991 | Laky et al. | 166/351 |
| 5,048,603 | 9/1991 | Bell et al. | 166/84.4 |
| 5,088,559 | 2/1992 | Taliaferro | 166/379 |
| 5,273,108 | 12/1993 | Piper | 166/90.1 |
| 5,538,080 | 7/1996 | Bassinger | 166/84.2 |
| 5,636,688 | 6/1997 | Bassinger | 166/84.4 |

FOREIGN PATENT DOCUMENTS 714185 8/1954 United Kingdom .

OTHER PUBLICATIONS

Sas–Jaworsky, A. et al., "Development of Composite Coiled Tubing for Oilfield Services", *Society of Petroleum Engineers,* presented at the 68th Annual Technical Conference and Exhibition of the Society of Petroleum Engineers, held in Houston, Texas on Oct. 3–6, 1993.

Sas–Jaworsky, A. et al., "Coiled Tubing 1995 Update: Production applications", *World Oil,* presented at World Oil's 3rd International Conference , held in Houston, Texas on Mar. 13–16, 1995.

Texas Oil Tools, Unit 1147, Brochure for the "2.50 DT Tandem Stripper/Packer 10,000 PSI", Dec. 1989.

Texas Oil Tools, Unit 1183, Brochure for the "2.50" Side Door Stripper/Packer 10,000 psi W.P. Jan. 1992.

van Adrichem, W. et al., "Development and Utilization of a Coiled Tubing Equipment Package for Work in High Pressure Wells", conference paper presented at the Offshore Technology Conference, held in Houston, Texas on May 1–4, 1995.

*Primary Examiner*—Hoang C. Dang
*Attorney, Agent, or Firm*—Lahive & Cockfiel, LLP

[57] ABSTRACT

In the use of composite materials for a coiled tubing for downhole use, precise external tubular dimension and durable wear surface become a critical factor because of the potential for damage to the external surface as the tubing passes through the stripper assembly at the wellhead which is provided to control high pressures within the well. An infuser arranged within the stripper provides lubrication for the passage of the composite tubing through the sealing members within the stripper and also infuses fluids into microfissures and cracks naturally occurring on the surface of the composite tubing to fill the voids and thereby enhance the structural integrity of the tubing.

8 Claims, 2 Drawing Sheets

INFUSER FOR COMPOSITE SPOOLABLE PIPE

RELATED APPLICATIONS

This application claims the benefit of and incorporates by reference the commonly-owned, co-pending U. S. Provisional Application No., 60/014,025, filed on Mar, 25, 1996.

This invention pertains to a method and apparatus for infusing a fluid material onto the surface of a spoolable composite pipe and more particularly to infusing materials onto the composite pipe as it is passed through the stripper of a spoolable pipe injector such as is used for injecting and pulling coiled tubing from a subsurface wellbore.

BACKGROUND OF THE INVENTION

A spoolable pipe in common use is steel coiled tubing which finds a number of uses in oil well operations. For example, it is used in running wireline cable down hole with well tools, such as logging tools and perforating tools. Such tubing is also used in the workover of wells, to deliver various chemicals downhole and perform other functions. Coiled tubing offers a much faster and less expensive way to run pipe into a wellbore in that it eliminates the time-consuming task of joining typical 30 foot pipe sections by threaded connections to make up a pipe string that typically may be up to 10,000 feet or longer.

Steel coiled tubing is capable of being spooled because the steel used in the product exhibits high ductility (i.e. the ability to plastically deform without failure). The spooling operation is commonly conducted while the tube is under high internal pressure which introduces combined load effects. Unfortunately, repeated spooling and use causes fatigue damage and the steel coiled tubing can suddenly fracture and fail. Such a potential hazard of the operation and attendant risk to personnel, plus the high economic cost of such a failure in down time to conduct fishing operations, forces the product to be retired, before any expected failure, after a relatively few number of trips into a well. The cross section of steel tubing expands during repeated use resulting in reduced wall thickness and higher bending strains with associated reduction in the pressure carrying capability. In general steel coiled tubing presently in service is limited as to internal pressures of about 5000 psi. Higher internal pressure significantly reduces the integrity of coiled tubing so that it will not sustain continuous flexing and thus severely limits its service life. At very high working pressures the coiled tubing may be limited to a single field application. The initial state of the coiled tubing used in these operations is in a spooled condition on a reel. Three bending events occur going into the wellbore and three upon on its retrieval. In general service work it is common to cycle in and out of the well over short intermediate intervals. When the internal pressure in steel body of the pipe is above 30 percent of the tubing yield rating, when it is bending, significant plastic deformation takes place in the pipe.

It is therefore desirable to use a substantially non-ferrous composite spoolable pipe capable of being deployed and spooled under borehole conditions and which does not suffer from the structural limitations of steel tubing and which is also highly resistant to chemicals. Such spoolable pipe products are now being developed and are generally constructed by imbedding fibrous materials in a resin matrix. These products typically utilize a build up of laminate layers with the fibers in each layer oriented in a particular direction (or directions when a fabric or braided construction is used). Such pipe is described in SPE paper #26536 entitled "Development of Composite Tubing for Oilfield Services", by Sas-Jaworsky and Williams, Copyright 1993, Society of Petroleum Engineers, Inc.

An injector system is used to inject and retrieve spoolable pipe from a wellbore in such oilfield services. A part of the injector system is a stripper device using elastomeric elements to sealingly engage the outer surface of the pipe as it is injected into or pulled out of the well. These sealing elements isolate the higher pressure borehole environment from the ambient surface pressure. The functional engagement of the injector mechanism and of these sealing elements in the stripper with a composite pipe, tends to damage the surface integrity of a composite material, which can cause wellbore fluid pressure to bypass the stripper. When composite pipe is used in these applications, repeated bending of the composite materials as well as frictional engagement of the pipe with the stripper elements may cause fissures to form in the surface of the composite pipe. It is desirable to diminish the frictional disturbance between the outer surface of the pipe and these stripper elements. It is therefore an object of the present invention to provide a new and improved method and apparatus for applying and infusing a treating material into the outer surface of a spoolable composite pipe to reduce friction and the consequences of fissures caused by repeated stressing of the composite pipe in use.

SUMMARY OF THE INVENTION

With this and other objects in view, the present invention provides a method and apparatus for applying materials onto the outer surface of a composite pipe and infusing such materials into surface micro-fissures to lubricate the outer surface and fill micro-fissures in the surface. This will diminish wear on the surface layer and also help to minimize fluid migration across any pressure isolation device through which the composite pipe is passed in use.

DETAILED DESCRIPTION OF THE INVENTION

While the present invention is directed generally to a device for use with composite spoolable pipe, the disclosure is directed to a specific application of spoolable pipe involving coiled tubing service and in particular downhole uses of coiled tubing as described above. Composite coiled tubing offers the potential to exceed the performance limitations of isotropic metals, thereby increasing the service life of the pipe and extending operational parameters. Composite coiled tubing is constructed as a continuous tube, a major portion of which is usually fabricated from non-metallic materials to provide high body strength and wear resistance. This tubing can be tailored to exhibit unique characteristics which optimally address burst and collapse pressures, pull and compression loads, as well as high strains imposed by bending. This enabling capability expands the performance parameters of tubulars beyond the physical limitations of steel or alternative isotropic materials. In addition, the fibers and resins used in composite coiled tubing construction make the tube impervious to corrosion and resistant to chemicals encountered in the treatment of oil and gas wells.

The service life potential of composite coiled tubing is substantially longer than that of conventional steel pipe when subjected to multiple plastic deformation bending cycles with high internal pressures. Composite coiled tubing will provide the ability to extend the vertical and horizontal reach of existing concentric well services. The operational concept of a coiled tubing system involves the deployment of a continuous string of small diameter tubing into a wellbore to perform a specific well service procedure without disturbing the existing completion tubulars and equipment. When the service is completed, the small diameter tubing is retrieved from the wellbore and spooled onto a large reel for transport to and from work locations. Additional applications of coiled tubing technology are for drilling wells as well as for servicing other extended reach applications such as remedial work in pipelines.

Figure 1:
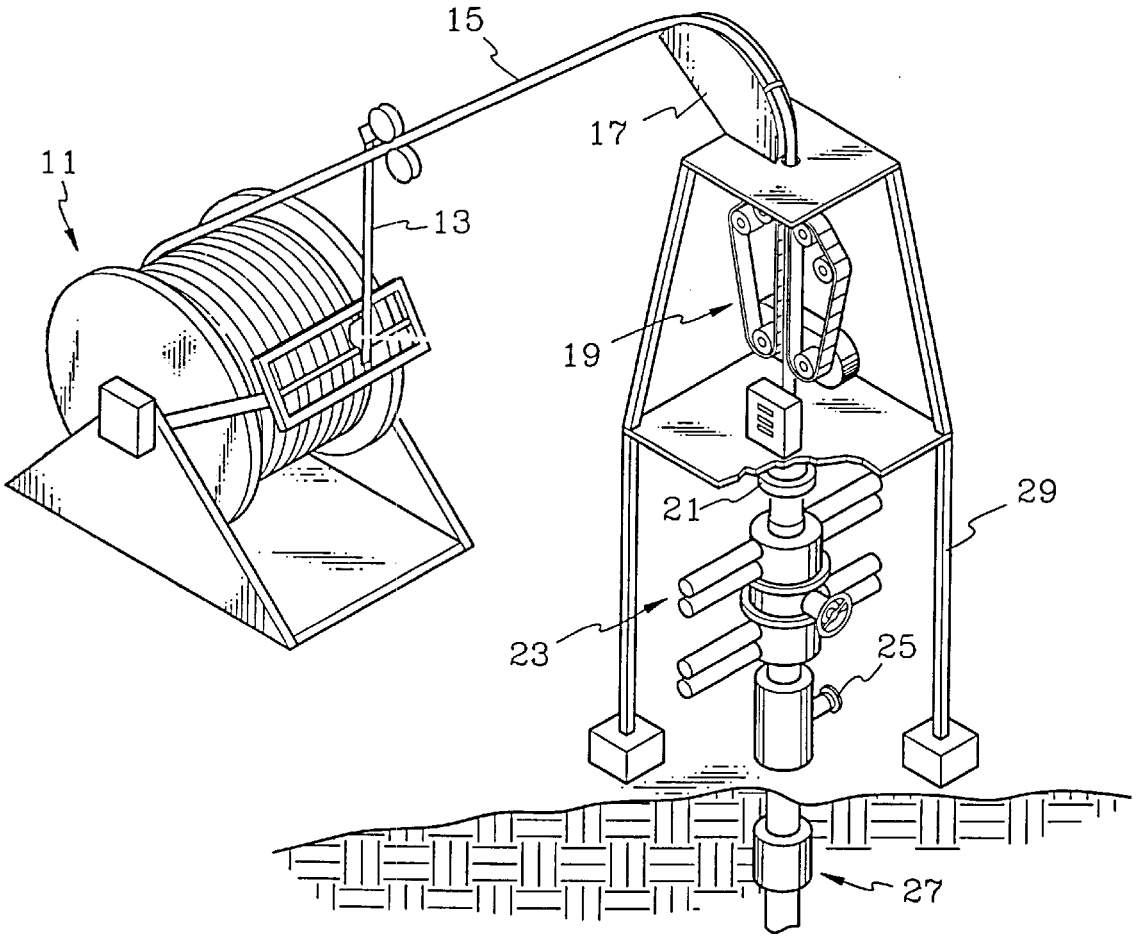
FIG. 1 is a schematic view of a coiled tubing injector mounted over a wellhead.

As shown in FIG. 1, the equipment components which most affect the performance of the tubing string are included in an injector system having a tubing guide arch 17, and a service reel 11. The tubing is deployed into or pulled out of the well with the injector head 19. The most common design of injector head utilizes two opposed sprocket drive traction chains which are powered by hydraulic motors. Gripper blocks on the chains are forced onto the pipe by a series of hydraulically actuated compression rollers that impart the gripping force required to create and maintain the friction drive system. The tubing guide arch 17 is mounted directly above the injector head and is constructed as a 90-degree arched roller system to receive the tubing from the reel 11 and guide it into the chain blocks on the injector head. The coiled tubing 15 is bent over the tubing guide arch by applied tension from the reel to ensure that the tubing remains on the arched roller. The coiled tubing reel is a fabricated steel spool with a core diameter presently ranging from 60 to 84 inches (depending upon the size of coiled tubing in use) and is equipped with a rotating high pressure swivel which allows for continuous fluid pumping services to be performed even when the pipe is in motion.

The high performance composite structures that are being developed for this application are generally constructed as a buildup of laminant layers with the fibers in each layer oriented in a particular direction or directions. These fibers are normally locked into a preferred orientation by a surrounding matrix material. The matrix material, normally much weaker than the fibers, serves the critical role of transferring load into the fibers. Fibers having a high potential for application in constructing composite pipe include glass, carbon, and aramid. Epoxy or thermoplastic resins are good candidates for the matrix material.

The outer surface of such composite pipe will also be required to act as a wear surface as the pipe engages the surface equipment utilized in handling such pipe. Referring again to FIG. 1, the surface handling equipment further includes a hydraulic levelwind mechanism 13 for guiding coiled tubing on and off the reel 11. The tubing 15 passes over the tubing guide arch 17 which provides a bending radius for moving the tubing into a vertical orientation for injection through wellhead devices into the wellbore. The tubing passes from guide 17 into the powered injector head 19 which grippingly engages the tubing and pushes it into the well. A stripper assembly 21 under the injector maintains a dynamic and static seal around the tubing to hold well pressure within the well as the tubing passes into the wellhead devices which are under well pressure. The tubing then moves through a blowout preventor (BOP) stack 23, a flow tee 25, and wellhead master valve or tree valve 27 as it passes into the wellpipe. An injector support 29 has legs that are adjustable to allow the injector to be positioned over the wellhead stack positioned below it. A quick connect fitting is placed between the BOP and the stripper above. When making up the coiled tubing tool string for running into a well, the following procedure is followed. First, the wellhead tree valve is closed to seal off the well and the BOP stack is opened. Then, the service end of the coiled tubing is run over the guide 17 and through the injector 19 and stripper 21 (injector assembly). A length is run through this injector assembly where a connector and tools are assembled onto the leading end of the tubing 15. When a side door or radial stripper is used, such as manufactured by Texas Oil Tools, constraining bushings, for use in sealing about the pipe, maybe removed from the stripper and the connector and tools can be mounted on the tubing 15 prior to running it through the injector assembly. The constraining bushings or sealing elements are then reinserted.

After the tools are connected, the injector assembly is raised with the tools extending from the bottom and lowered into the top of the BOP stack. This provides about 8 feet of space to receive the tool string. A lubricator can be used to extend this distance. The stripper 21 is bumped up on the stack and the quick union on the bottom of the stripper and top of the BOP stack is made up. A pressure test is conducted with the wellhead tree closed and the coiled tubing open into the flow tee at the bottom of the BOP stack. This procedure pressure tests surface treatment lines, wellhead connectors and flow control devices. Next, the pressure on the coiled tubing system and control stacks is matched to the well pressure and the well is opened. The coiled tubing string is then run into the well.

The outer surface layer on composite pipe is subjected to deteriorating forces when subjected to repeated bending in use and frictional engagement with the stripper element or constraining bushings as it moves through the stripper. Repeated usage of the pipe causes micro-fissures and cracks to occur in the fibers and resin matrix. These stress fractures will tend to connect after repeated bending cycles and thus develop blow-by; i.e., fluids under higher pressure in the well will bypass the stripper into the lower pressure surface environment as the pressured fluids find an interlaminant flow path created by the fissures.

In addition, while the manufactured surface of the pipe is relatively smooth, the fibrous nature of the pipe and fissures caused by bending generate the need for lubrication of the outer wear surface to avoid friction with the stripper which will result as the edges of fibers and fissures engage the stripper element. This friction will eventually begin dissociation of the composite matrix of the pipe. An additional problem in the use described above is the wearing out of the stripper element or bushing in the stripper.

Figure 2:
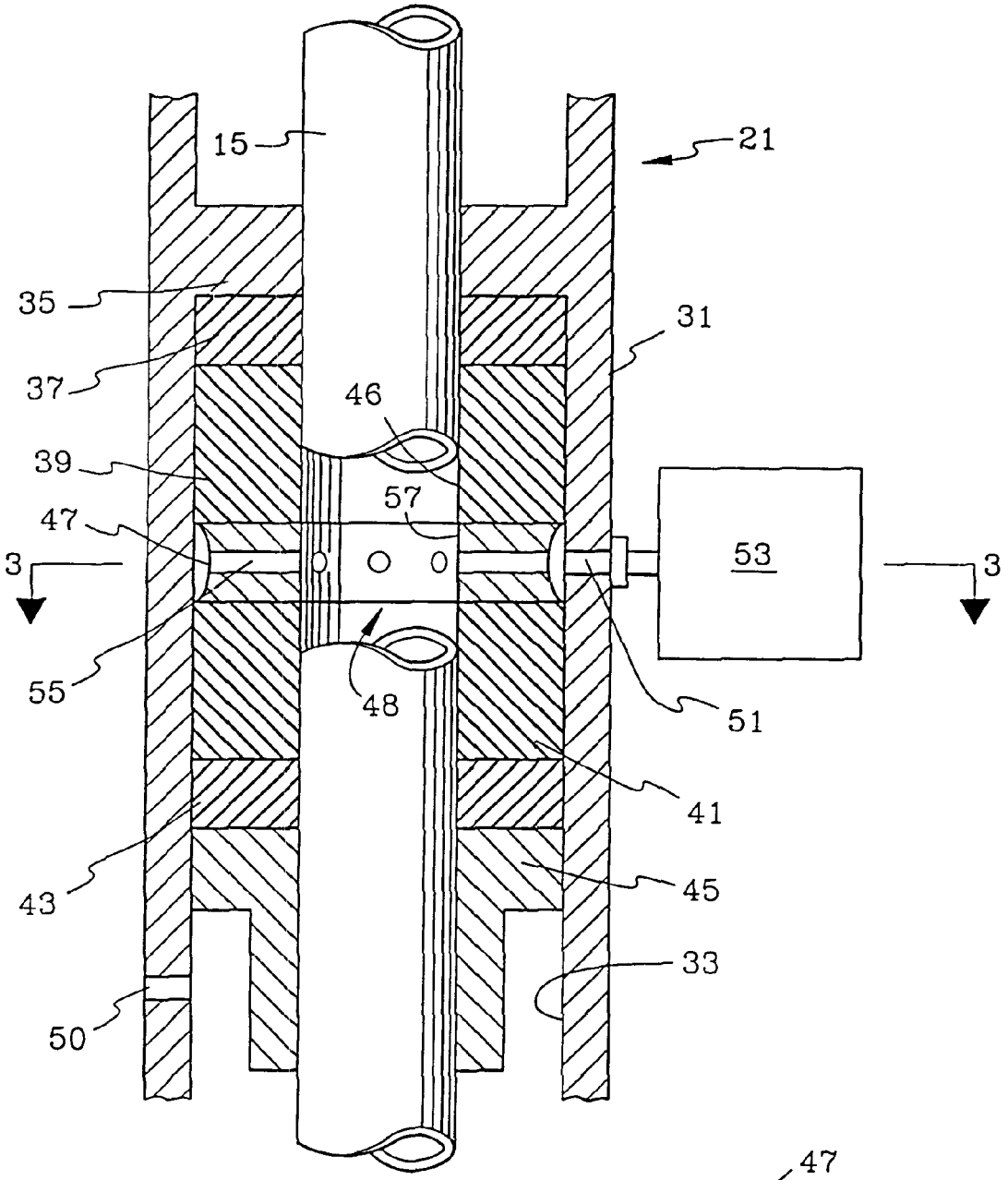
FIG. 2 shows an elevational view in cross section of a stripper for use in a spoolable pipe injector system to isolate downhole pressure in a wellbore during a coiled tubing operation.
Figure 3:
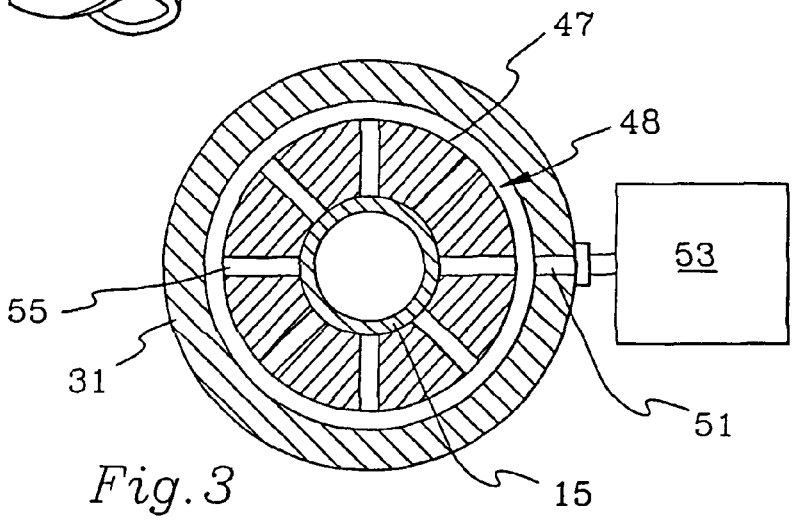
FIG. 3 is a cross-sectional plan view of the infuser taken along lines 3—3 of FIG. 2.

Referring now to FIG. 2 of the drawings, the stripper 21 has a housing 31 with a longitudinal bore portion 33 in the housing. An annular restraining shoulder 35 is positioned in the housing bore 33. An upper retaining ring 37 is positioned between the shoulder 35 and an upper stripper element 39. A lower stripper element 41 engages a lower retaining rig 43 which in turn is supported by a piston 45. A central longitudinal stripper bore 46 extends throughout the stack of components just described within the bore 33 of the housing; i.e., the shoulder 35; upper and lower elements 39, 41; upper and lower retaining rings 37 and 43; and piston 45. A port 50 in housing 31 provides a means to supply an energizing fluid under pressure to the bottom side of piston 45. In this manner, the piston may be moved upwardly, as viewed, against the piston to compress the upper and lower elements 39, 41, and thereby expand the elements radiantly into sealing contact with the bore 33 of housing 31 and with the outer surface of tubing 15 passing through the stripper. This stripper bore 46 is sized to receive the outside diameter of the coiled tubing 15 which passes through the stripper apparatus 21. The components described above represent at least functionally that which exists in a state of the art stripper (with the exception of the stripper element being divided into upper and lower elements 39 and 41; respectively).

In order to overcome the problems associated with friction and micro-fissures in the surface of the spoolable composite pipe, the stripper of FIG. 2 is modified over the prior art configuration as follows: the stripper element is divided into the upper and lower elements 39, 41 as shown in FIG. 2 so that an infuser injector ring 48 can be positioned between the upper and lower elements 39, 41. The infuser ring 48 is shown having a concave outer peripheral surface which provides an annular cavity 47 about the ring. The wall of housing 31 is provided with an injection port 51 which communicates the annular cavity 47 with a fluid reservoir shown schematically at 53. The reservoir is provided with a source of fluid pressure (not shown) so that fluid in the reservoir can be supplied under pressure to the port 51 and cavity 47 surrounding infuser ring 45.

Radial passages 55 are formed in the peripheral wall of infuser ring 48 to provide a fluid passageway between the cavity 47 and an interior bore 57 in the center of the injection ring 48. These passages permit the fluids under pressure in reservoir 53 to be transmitted into the bore 57 of the injection ring and thus onto the outer surface of the coiled tubing passing through the bore 57 as it traverses the stripper 21. Thus the fluid medium contained in reservoir 53 is applied to pipe surface whereupon it may provide a lubricating effect or, depending on the fluid, a remedial effect. Lubricants could range from oils and grease to colloidal fluids using particulates such as Teflon PTFE, Tefzel Fluoropolymer, nylon, etc.

When the infuser device is used for remediation of the coiled tubing surface, pressure applied to the fluid in reservoir 53 causes the fluid to be forced into micro-fissures and cracks in the surface of the tubing as well as by the application of pressure from the two stripper elements. Radial pressure from the stripper elements can be regulated by movement of piston 45 against and away from the lower retaining ring 43. This in turn causes radial expansion and contraction respectively of the upper and lower stripper elements 39, 41. Remediation or repair materials could include resins, epoxies, and synthetic polymeric substances such as silicon, etc.

The infuser device can be used to enhance the working life of the exterior surface of the tubing by providing "in-line" resin/epoxy application to the composite tube after periodic tubing services. Although means are not shown in the drawings, heat may be applied to the fluid materials or to portions of the stripper assembly to enhance the application and curing of repair surfaces on the composite coiled tube.

While a particular embodiment of the present invention has been shown and described, it is apparent that changes and modifications may be made without departing from this invention in its broader aspects, and therefore, the aim in the appended claims is to cover all such changes and modifications as fall within the true spirit and scope of this invention.

I claim:

1. A stripper apparatus for facilitating the movement of composite pipe into and out of a work environment having a pressure differential between the ambient pressure surrounding the composite pipe at the surface and the pressure surrounding the composite pipe in its work environment, the composite pipe having an outer surface formed of composite fibers embedded in a matrix material, the stripper apparatus comprising a resilient element having a longitudinal bore to receive the composite pipe and providing a seal between the ambient pressure on the composite pipe and the pressure on the composite pipe in its work environment, a source of remedial fluid adapted for repairing fissures formed in the outer surface of the composite pipe, and an infuser supplying remedial fluid from said source of remedial fluid to said longitudinal bore of said resilient element and to the outer surface of the composite pipe.

2. The stripper apparatus of claim 1, wherein said remedial fluid comprises the matrix material forming the outer surface of the composite pipe.

3. The stripper apparatus of claim 1, wherein said remedial fluid is a resin.

4. The stripper apparatus of claim 1, wherein said remedial fluid is an epoxy.

5. The stripper apparatus of claim 1, wherein said remedial fluid is a synthetic polymer.

6. The stripper apparatus of claim 5, wherein said synthetic polymer is silicon.

7. The stripper apparatus of claim 1, further comprising a second resilient element, said infuiser being positioned between said resilient element and said second resilient element.

8. The stripper apparatus of claim 1, wherein said infuser comprises a ring having radial passageways formed therein to transmit said remedial fluid from said source of remedial fluid to said longitudinal bore of said resilient element and to the outer surface of the composite pipe.

* * * * *

UNITED STATES PATENT AND TRADEMARK OFFICE

CERTIFICATE OF CORRECTION

PATENT NO. : 5,944,099
DATED : August 31, 1999
INVENTOR(S) : Alexander Sas-Jaworsky It is certified that error appears in the above-identified patent and that said Letters Patent is hereby corrected as shown below:

Title page,
Please add -- Related U.S. Application Data, Provisional application No. 60/014,025, filed on March 25, 1996 --.

Signed and Sealed this

Fifth Day of March, 2002

*Attest:*

*Attesting Officer*

JAMES E. ROGAN
*Director of the United States Patent and Trademark Office*